US011766131B2

(12) United States Patent
Bellingroth

(10) Patent No.: US 11,766,131 B2
(45) Date of Patent: Sep. 26, 2023

(54) BED WITH MULTIPLE BED UNITS

(71) Applicants: JIAXING SINO HARDWARE MANUFACTURING COMPANY LIMITED, Jiaxing (CN); SINO INTERNATIONAL GROUP LIMITED, Monkok (HK)

(72) Inventor: Klaus Bellingroth, Gummersbach (DE)

(73) Assignees: TFC TECHNOLOGY CO., LTD, Jiaxing (CN); SINO INTERNATIONAL GROUP LIMITED, Monkok (HK)

( * ) Notice: Subject to any disclaimer, the term of this patent is extended or adjusted under 35 U.S.C. 154(b) by 202 days.

(21) Appl. No.: 16/841,709

(22) Filed: Apr. 7, 2020

(65) Prior Publication Data

US 2021/0022517 A1 Jan. 28, 2021

Related U.S. Application Data

(63) Continuation-in-part of application No. 16/521,273, filed on Jul. 24, 2019, now abandoned.

(30) Foreign Application Priority Data

Feb. 14, 2020 (CN) ..... 202010093881.1

(51) Int. Cl.
*A47C 20/04* (2006.01)
*A47C 19/00* (2006.01)
*A47C 19/12* (2006.01)

(52) U.S. Cl.
CPC ..... *A47C 20/04* (2013.01); *A47C 19/005* (2013.01); *A47C 19/122* (2013.01)

(58) Field of Classification Search
CPC ..... A47C 20/04; A47C 19/005; A47C 19/122; A47C 20/041
USPC ..... 5/618
See application file for complete search history.

(56) References Cited

U.S. PATENT DOCUMENTS 1,253,625 A * 1/1918 Morphis ..... A47C 19/025 5/310
2,211,453 A * 8/1940 Buttikofer ..... A47C 20/041 5/616
3,121,237 A * 2/1964 Brindisi ..... A47C 19/122 5/36
3,636,573 A * 1/1972 Bartz ..... A61G 7/015 5/660

(Continued)

*Primary Examiner* — David R Hare
*Assistant Examiner* — Luke Hall
(74) *Attorney, Agent, or Firm* — Andrew C. Cheng

(57) ABSTRACT

A foldable bed includes a first bed unit, a second bed unit rotatably connected to the first bed unit such that the bed is rotatable between a folded state and an unfolded state, and a stop unit arranged between the first bed unit and the second bed unit for preventing the first bed unit and the second bed unit from rotating relative to each other when the bed is at the unfolded state. The first bed unit includes a first support bracket and a first platform part supported on the first support bracket. The second bed unit includes a second support bracket and a second platform section supported on the second support bracket. When the bed is at the unfolded state the second platform section and the first platform section cooperatively form a platform of the bed for supporting a load.

12 Claims, 11 Drawing Sheets

(56) References Cited

U.S. PATENT DOCUMENTS 5,386,601 A * 2/1995 Kohl ..... A47C 19/122 5/174
5,519,902 A * 5/1996 Meade ..... A47C 20/04 5/47
5,964,347 A * 10/1999 Urness ..... B65D 85/64 206/326
6,009,575 A * 1/2000 Hsieh ..... A47C 19/122 5/174
6,076,210 A * 6/2000 Wu ..... A61G 7/015 5/174
6,101,648 A * 8/2000 Sommerfeld ..... A61G 7/015 5/613
6,125,772 A * 10/2000 Clements ..... B60N 3/002 108/115
6,357,065 B1 * 3/2002 Adams ..... A61G 7/015 5/617
6,516,479 B1 * 2/2003 Barbour ..... A61G 7/015 5/152
6,752,091 B2 * 6/2004 Glover ..... A47B 3/087 108/169
6,948,688 B1 * 9/2005 Payne ..... A47C 19/024 5/509.1
6,990,698 B2 * 1/2006 Wall, Sr. ..... A47C 20/041 5/618
7,207,622 B2 * 4/2007 Cohan ..... A47C 1/143 5/112
7,237,288 B2 * 7/2007 Lemire ..... A61G 7/052 5/617
7,278,361 B2 * 10/2007 Zhurong ..... A47B 3/0912 108/169
7,337,728 B2 * 3/2008 Shabram, Jr. ..... A47B 3/10 108/115
7,487,559 B1 * 2/2009 Denosky ..... A61G 7/1025 5/81.1 HS
7,676,861 B2 * 3/2010 Ward ..... A61G 7/0507 5/430
7,779,494 B2 * 8/2010 Poulos ..... A61G 7/16 5/618
7,886,380 B2 * 2/2011 Hornbach ..... A61G 7/015 5/613
8,370,973 B1 * 2/2013 Oh ..... A47C 19/122 5/177
8,407,837 B1 * 4/2013 Huang ..... A61G 7/002 5/116
8,418,291 B2 * 4/2013 Hornbach ..... A61G 7/0514 5/616
9,572,735 B2 * 2/2017 Johnson ..... A61G 7/018
9,668,587 B1 * 6/2017 Huang ..... A47C 19/005
9,713,388 B2 * 7/2017 Goldsmith ..... A47C 20/041
9,750,661 B2 * 9/2017 Lurie ..... A61G 13/1285
9,994,072 B2 * 6/2018 Lyon ..... B60B 33/0092
10,219,958 B2 * 3/2019 Johnson ..... A61G 7/08
2002/0144350 A1 * 10/2002 Shih ..... A61G 7/005 5/616
2004/0055086 A1 * 3/2004 Owens, Jr. ..... A47C 19/005 5/400
2008/0276872 A1 * 11/2008 Chern ..... A47C 19/122 119/28.5
2009/0113626 A1 * 5/2009 Harrow ..... A47C 19/005 5/132
2009/0293197 A1 * 12/2009 Larson ..... A61G 7/002 5/613
2010/0005587 A1 * 1/2010 Choi ..... A47C 19/122 5/202
2010/0116174 A1 * 5/2010 Chen ..... A47C 19/122 108/36
2010/0229303 A1 * 9/2010 Goldsmith ..... A47C 19/005 5/285
2011/0099712 A1 * 5/2011 Jin ..... A47C 19/122 5/174
2012/0222216 A1 * 9/2012 Jin ..... A47C 19/122 5/400
2012/0266382 A1 * 10/2012 Goddert ..... A61G 7/015 5/616
2013/0276228 A1 * 10/2013 Hsieh ..... A47C 19/122 5/400
2013/0312185 A1 * 11/2013 Suh ..... A47C 20/043 5/618
2014/0259396 A1 * 9/2014 McCarty ..... A47C 19/028 5/400
2014/0325759 A1 * 11/2014 Bly ..... A61G 7/015 5/613
2014/0366267 A1 * 12/2014 Suh ..... A47C 20/041 5/174
2015/0250323 A1 * 9/2015 Goldsmith ..... A47C 19/12 5/11
2016/0206088 A1 * 7/2016 Illulian ..... A47B 3/083
2017/0119166 A1 * 5/2017 An ..... A47C 17/40
2017/0258239 A1 * 9/2017 Xie ..... A47C 27/002
2017/0360209 A1 * 12/2017 Zhou ..... A61G 7/015
2018/0014656 A1 * 1/2018 Guohong ..... A47C 19/122
2018/0116413 A1 * 5/2018 Lo ..... A47C 17/82
2018/0116414 A1 * 5/2018 Lo ..... A47C 21/046
2018/0132625 A1 * 5/2018 Bellingroth ..... A47C 20/041
2019/0021507 A1 * 1/2019 Shan ..... A47C 19/00
2019/0150625 A1 * 5/2019 Lee ..... A47C 19/024
2019/0174928 A1 * 6/2019 Choi ..... A47C 19/122
2019/0231078 A1 * 8/2019 Chung ..... A47C 19/025
2019/0239653 A1 * 8/2019 Shan ..... A47C 20/041
2019/0328143 A1 * 10/2019 Choi ..... A47C 20/18
2019/0328593 A1 * 10/2019 Choi ..... A61G 7/018
2020/0054145 A1 * 2/2020 Shih ..... A47C 23/005
2020/0078238 A1 * 3/2020 Huang ..... A61G 7/012
2020/0178695 A1 * 6/2020 Shih ..... A47C 20/041
2020/0187662 A1 * 6/2020 Zeng ..... A47C 19/122
2020/0214460 A1 * 7/2020 Wang ..... A47C 21/006
2020/0214462 A1 * 7/2020 Wang ..... A47C 19/122
2020/0214463 A1 * 7/2020 Xie ..... A47C 20/041
2020/0237105 A1 * 7/2020 Eskridge, III ..... A47C 19/122
2020/0367660 A1 * 11/2020 Tsai ..... A47C 20/04

* cited by examiner

BED WITH MULTIPLE BED UNITS

CROSS REFERENCE

The application is a continuation-in-part of U.S. patent application Ser. No. 16/521,273, filed on Jul. 24, 2019, and claims priority under 35 U.S.C. 119(a) from Patent Application No. 202010093881.1 filed in The People's Republic of China on Feb. 14, 2020.

FIELD

The present invention relates to beds with multiple bed units and, in particular, to a bed with multiple bed units that can be folded or laid to each other to reduce the bed thickness for storage or transportation.

BACKGROUND

A bed includes a platform for supporting a load such as a human body, and a support assembly mounted below the platform. The bed is often folded to reduce size before packaged into a carton for transportation. During bed folding, two parts of the platform are folded to each other, with parts of the support assembly located on opposite outer surfaces of the folded platform. However, the folded bed may have a large overall thickness, which may lead to a high transportation cost.

SUMMARY

Accordingly, a fed with multiple bed units that can have a reduced thickness for transportation or storage is provided.

In one aspect, a foldable bed comprises a support member comprising a first support bracket and a second support bracket; and a platform for supporting a load, the platform comprising a first platform part supported on the first support bracket and a second platform part supported on the second support bracket. The first support bracket is rotatably connected to the second support bracket such that the first platform part and the second platform part are rotatable relative to between a folded state and an unfolded state. A stop unit is arranged between the first platform part and the second platform part for preventing the first platform part and the second platform part from rotating relative to each other when the bed is at the unfolded state.

In one embodiment, the stop unit comprises a pair of mounting bases respectively mounted to the first and second platform parts, a connecting rod connected between the mounting bases and a restricting member connected to the connecting rod and configured to prevent the connecting rod from removing off from the mounting bases.

In one embodiment, each of the mounting bases defines a through hole, the connecting rod extending through the through holes, the restricting member being mounted to an end of the connecting rod.

In one embodiment, the restricting member comprises a nut, the end of the connecting rod has threads meshed with the nut.

In one embodiment, the bed defines a longitudinal direction and a lateral direction perpendicular to the longitudinal direction, the first platform part and the second platform part being arranged in the longitudinal direction, the first support bracket and the second support bracket being offset-arranged in the lateral direction to avoid interference between the first support bracket and the second bracket when the bed is at the folded state.

In one embodiment, a first actuator is connected to the first platform part and the first support bracket for driving the first platform part to move relative to the first support bracket, and a second actuator is connected to the second platform part and the second support bracket for driving the second platform part to move relative to the second support bracket, the first actuator and the second actuator being offset-arranged in the lateral direction to avoid interference between the first actuator and the second actuator when the bed is at the folded state.

In one embodiment, the first support bracket comprises two first rotation arms and a first support rod arranged between the two first rotation arms, the second support bracket includes two second rotation arms and a second support rod arranged between the two second rotation arms, an end of the first rotation arm being hinged to an end of the second rotation arm.

In one embodiment, the first platform part comprises a first platform section and a second platform section pivotably connected to the first platform section, the first platform section being adjacent to the second platform part and the second platform section being away from the second platform part, one end of the actuator being pivotably connected to the first support rod and the other end of the actuator being pivotably connected to the second platform section.

In one embodiment, the second platform part comprises a third platform section, a fourth platform section and a fifth platform section, the third platform section being adjacent to the first platform part, the fourth platform section being pivotably connected to the third platform section, and the fifth platform section being pivotably connected to the fourth platform section, an end of the second actuator being pivotably connected to the second support rod and the other end of the second actuator being pivotably connected to the fourth platform section.

In one embodiment, the first, second, third, fourth and fifth platform sections each comprises a part of a support frame and a hollow portion.

In one embodiment, a distance between the two first rotation arms is less than a distance between the two second rotation arms so as to prevent interference between the first rotation arm and the second rotation arm during a folding process of the bed.

In one embodiment, a support seat is provided on lower surfaces of the first and second rotation arms, when the bed is at the unfolded state, a distance between the lower surface of the support seat and the ground is less than a distance between the lowermost end of the first actuator and the ground, and the distance between the lower surface of the support seat and the ground is less than a distance between the lowermost end of the second actuator and the ground.

In one embodiment, the support seat is offset from the support frame, when the bed is at the folded state, the support seat is located in the hollow portion.

In one embodiment, a clamping member is provided at an end of a hinge shaft through which the first rotation arm is pivotably connected to the second rotation arm, for securing the hinge shaft between the first rotation arm and the second rotation arm.

In one embodiment, the fifth platform section is provided with a recess at a portion of the support frame below the pushing end of the second actuator, a groove being formed at a bottom of the recess to allow rotation of the pushing end of the second actuator therein.

In another aspect, a foldable bed comprises a first bed unit comprising a first support bracket and a first platform part supported on the first support bracket; a second bed unit rotatably connected to the first bed unit such that the bed is rotatable between a folded state and an unfolded state, the second bed unit comprising a second support bracket and a second platform section supported on the second support bracket; and a stop unit arranged between the first bed unit and the second bed unit for preventing the first bed unit and the second bed unit from rotating relative to each other when the bed is at the unfolded state. When the bed is at the unfolded state the second platform section and the first platform section cooperatively form a platform of the bed for supporting a load.

In one embodiment, the first support bracket and the second support bracket are offset-arranged in the lateral direction to avoid interferences between the first support bracket and the second bracket when the bed is at the folded state and the first bed unit and the second bed unit are laid to each other, with the first support bracket and the second support bracket being laid into each other and sandwiched between the first platform part and the second platform part.

In summary, the present invention provides a bed with multiple bed units that can be connected to cooperatively form a complete bed. The multiple bed units can be rotatably connected to each other, or connected using another connecting system, such as using at least one connecting bar. By offset-arranging the first support bracket and the second support bracket in the lateral direction, the first support bracket and the second support bracket do not interference with each other when the first and second bed units are folded or laid into each other. Therefore, the bed thickness after the first and second bed units are folded or laid into each other can be greatly reduced, thus reducing the packaging size of the bed and hence reducing the cost in transportation of the bed. The stop unit is arranged between the first bed unit and the second bed unit, in order to stop the first bed unit and the second bed unit from rotating relative to each other when the bed is at the unfolded state, whereby improving stability of the bed in use.

Other independent aspects of the invention will become apparent by consideration of the detailed description, claims and accompanying drawings.

DESCRIPTION OF THE EMBODIMENTS

Figure 1:
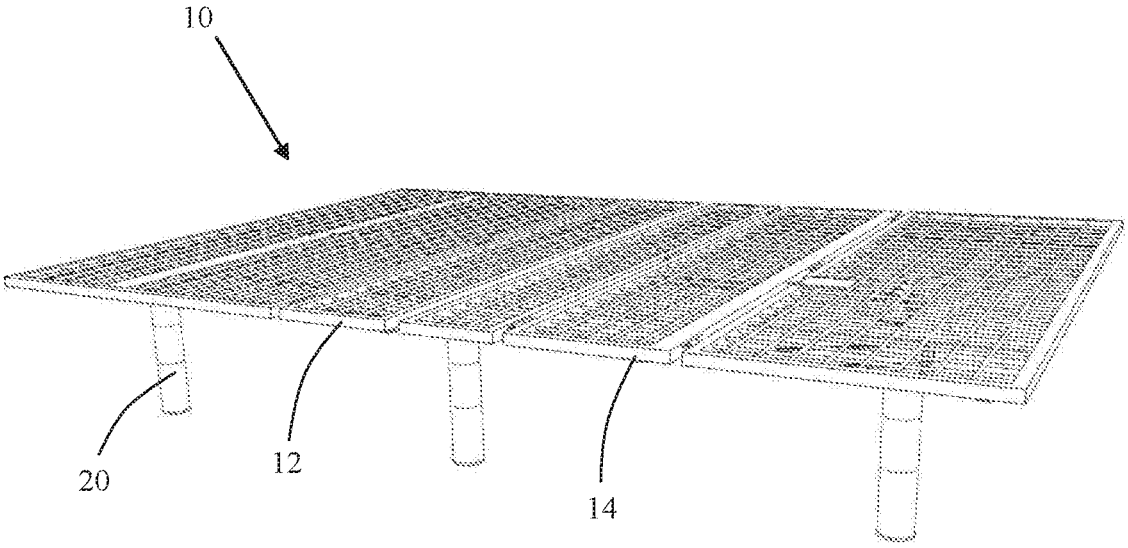
FIG. 1 is a perspective view of a bed with multiple bed units.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

The present invention provides a bed with multiple bed units. The multiple bed units are configured to be connected to cooperatively form a complete bed. For storage or transportation purposes, the multiple bed units can be folded or laid to each other to reduce the bed thickness. Embodiments of the present invention will be described in detail below in connection with a bed with two bed units. It is to be understood that the present invention may be equally applied in a bed with more than two bed units.

FIG. 1 through FIG. 6 illustrate a bed 10 which, when folded, has a reduced thickness in comparison with the conventional foldable beds. The bed 10 includes a platform and a support assembly for supporting the platform. The bed and its platform define a longitudinal direction and a lateral direction perpendicular to the longitudinal direction. The platform is used to support a load, such as, a human body. Usually, a mattress is placed on the platform during use.

In the illustrated embodiment, the bed 10 includes a first bed unit and a second bed unit. The first bed unit and the second bed unit are arranged in the longitudinal direction and rotatably connected to each other in the illustrated embodiment of FIG. 1 through FIG. 6. The first bed unit includes a first platform section 12 and a first support bracket 16 mounted at an underside of the first platform section 12. The second bed unit includes a second platform section 14 and a second support bracket 18 mounted at an underside of the second platform section 14. The bed 10 may further include a plurality of support legs 20, some of which are detachably mounted to the first support bracket 16 and some others of which are detachably mounted to the second support bracket 18.

The first platform section 12 and the second platform section 14 cooperatively form the platform of the bed 10. The first support bracket 16, the second support bracket 18, and the support legs 20 cooperatively form the support assembly of the bed 10. In other words, the bed 10 is exemplarily split into two bed units, i.e. the first bed unit and the second bed unit; the first bed unit includes the first platform section 12, the first support bracket 16 and some legs 20 mounted to the first support bracket 16; the second bed unit includes the second platform section 14, the second support bracket 18 and some legs 20 mounted to the second support bracket 18.

The legs 20 are used as a support structure to support the platform at a level relative to a ground on which the bed 10 is placed. In other embodiments unillustrated, another type of support structure, such as a support bracket with height adjustment function (e.g. a scissor-type lifting bracket) may be used. In the illustrated embodiment, there are two additional legs 20 mounted at a middle of the platform. Specifically, the two legs 20 are mounted to the first support bracket 16 at the middle of the platform.

After the legs 20 are detached from the first and second support brackets 16, 18, the first platform section 12 and the second platform section 14 are capable of rotation relative to each other between a first or folded state and a second or unfolded state. In the unfolded state, the first platform section 12 and the second platform section 14 cooperatively form the platform for supporting the load. In the folded state, the first and second platform sections 12, 14 are folded to each other, with the first support bracket 16 and second support bracket 18 folded and sandwiched between the first platform section 12 and the second platform section 14. In this case, the overall thickness of the folded bed 10 is defined by the distance between outer surfaces of the folded first and second platform sections 12, 14. In order to minimize this overall thickness, in this embodiment, the first support bracket 16 and the second support bracket 18 are offset-arranged in the lateral direction of the bed 10, such that the first support bracket 16 and the second support bracket 18 do not interference with each other when the first and second platform sections 12, 14 are folded, making it possible to completely fold the first support bracket 16 and second support bracket 18 into each other. As a result, the distance between inner surfaces (which are bottom surfaces of the first and second platform sections 12, 14 when unfolded) of the folded first and second platform sections 12, 14 is approximately equal to a thickness of the first support bracket 16 or the second support bracket 18. The overall thickness of the folded bed 10 is therefore approximately equal to a sum of a thickness of the first platform section 12, a thickness of second platform section 14, and a thickness of the first support bracket 16 or second support bracket 18. The first platform section 12 and the second platform section 14 when folded are substantially parallel to each other. As used herein, the term "thickness" refers to the size perpendicular to the platform.

Figure 2:
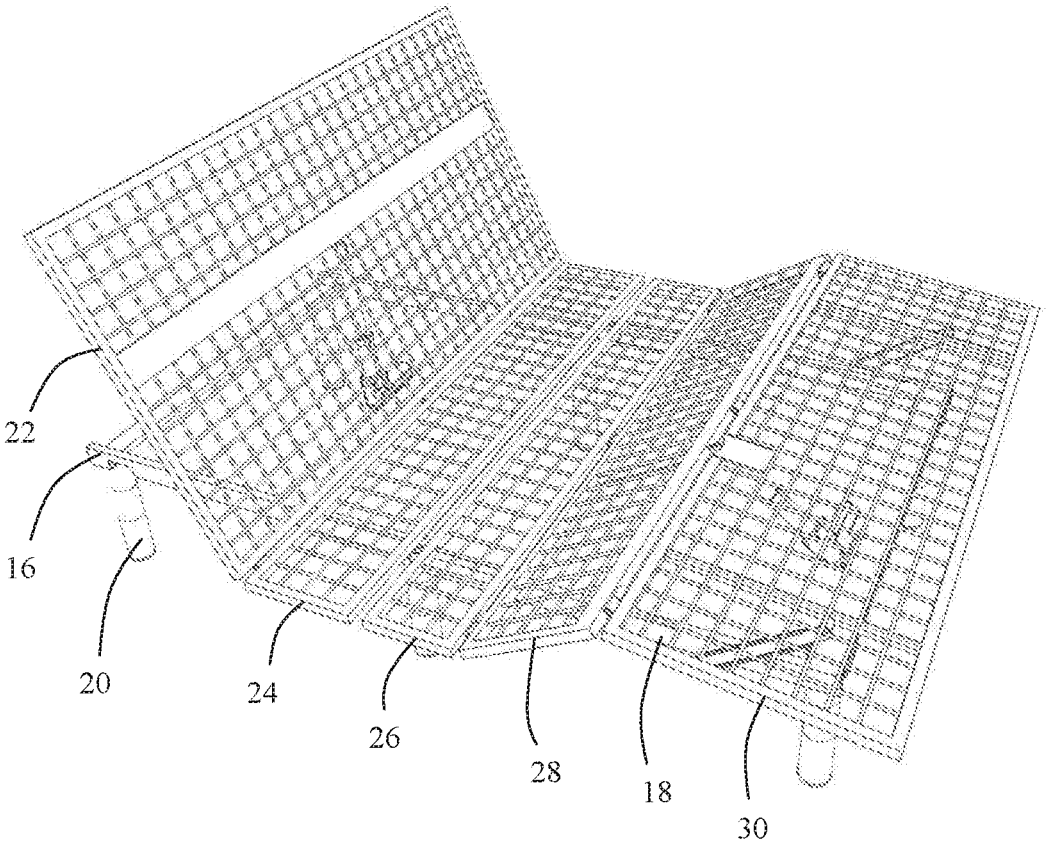
FIG. 2 is a perspective view of the bed of FIG. 1 in a lifted position.

In the illustrated embodiment, parts of the bed 10 may be lifted up to accomplish more comfortable positioning to users. For example, FIG. 1 shows the platform in a flat configuration, and FIG. 2 shows the platform which has a head end and a foot end lift up. Specifically, the first platform section 12 includes a first flat plate portion 24 and a backrest portion 22 rotatably connected to the first flat plate portion 24. The second platform section 14 includes a second flat plate portion 26, a thigh support portion 28 rotatably connected to the second flat plate portion 26, and a crus support portion 30 rotatably connected to the thigh support portion 28. The crus support portion 30 is further connected to the second support bracket 18 by linking rods 31. Each linking rod 31 has one end rotatably connected to the crus support portion 30, and an opposite end rotatably connected to the second support bracket 18. In this case, the first bed unit further includes a first actuator 32, and the second bed unit further includes a second actuator 34. The first actuator 32 is connected between the first platform section 12 and the first support bracket 16, for driving the first platform section 12 to move relative to the first support bracket 16. The second actuator 34 is connected between the second platform section 14 and the second support bracket 18, for driving the second platform section 14 to move relative to the second support bracket 18. In the illustrated embodiment, the first actuator 32 and the second actuator 34 are also offset-arranged in the lateral direction, which avoids interference with each other during the folding operation.

In the illustrated embodiment, the first platform section 12 and the second platform section 14 are not directly connected to each other. Rather, the first support bracket 16 and the second support bracket 18 are hinged to each other, i.e. rotatable connection is only formed between the first support bracket 16 and the second support bracket 18. The first flat plate portion 24 is fixed to the first support bracket 16, and the second flat plate portion 26 is fixed to the second support bracket 18. Therefore, as the second support bracket 18 rotates relative to the first support bracket 16, it will bring the second flat plate portion 26 to rotate relative to the first flat plate portion 24, thus achieving the folding operation between the first platform section 12 and the second platform section 14.

In some other embodiments, the first platform section 12 can be hinged to the second platform section 14. In this case, no direction connection is needed between the first support bracket 16 and the second support bracket 18. It should be understood that, for purposes of folding operation, rotatable connection can be formed between the first platform section 12/second platform section 14 and/or the first support bracket 16/second support bracket 18.

In the illustrated embodiment, the first support bracket 16 includes two spaced, parallel first longitudinal beams 36 and a plurality of first lateral beams 38 connected between the two first longitudinal beams 36. The two first longitudinal beams 36 extend in the longitudinal direction of the foldable bed 10 and are arranged and spaced in the lateral direction. The second support bracket 18 includes two spaced, parallel second longitudinal beams 40 and at least one second lateral beam 42 connected between the two second longitudinal beams 40. The two second longitudinal beams 40 extend in the longitudinal direction of the foldable bed 10 and are arranged and spaced in the lateral direction. In the illustrated embodiment, a lateral distance between the two first longitudinal beams 36 is less than a lateral distance between the two second longitudinal beams 40, such that the second support bracket 18 goes around the first support bracket 16 when the first and second bed units are folded, and the first and second support brackets 16, 18 are completely folded into each other. Alternatively, the first support bracket 16 may include a single first longitudinal beam 36 or more than two first longitudinal beams 36, and the second support bracket 18 may include a single second longitudinal beam 40 or more than two second longitudinal beams 40.

Each first longitudinal beam 36 has a first end, and one corresponding second longitudinal beam 40 has a second end, the first end and the second end rotatably connected to each other. The first end of each first longitudinal beam 36 is misaligned with the second end of the corresponding second longitudinal beam 40 along the longitudinal direction. Specifically, the first end each first longitudinal beam 36 is positioned at and connected to an inner side of the second end of the corresponding second longitudinal beam 40. As such, when the first support bracket 16 and the second support bracket 18 are folded into each other, the two first longitudinal beams 36 are both positioned at the inner sides of the second longitudinal beams 40, which avoids the interferences between the first longitudinal beams 36 and the second longitudinal beams 40, making the overall thickness of the folded bed as small as possible. The rotatable connection between the first end and the second end can be achieved in various ways. For example, each of the first end and the second end forms a pivot hole, and a connection pin is inserted through the pivot holes of the first end and second end to pivotably connect the first end and the second end. The pin-hole connection can be easy to implement for the beam elements of the first and second support brackets 16, 18. If the rotary connection is formed between the first platform section 12 and the second platform section 14, a separate hinge would be needed. From this perspective, it may be preferred to form the rotary connection between the first and second support brackets 16, 18.

Figure 5:
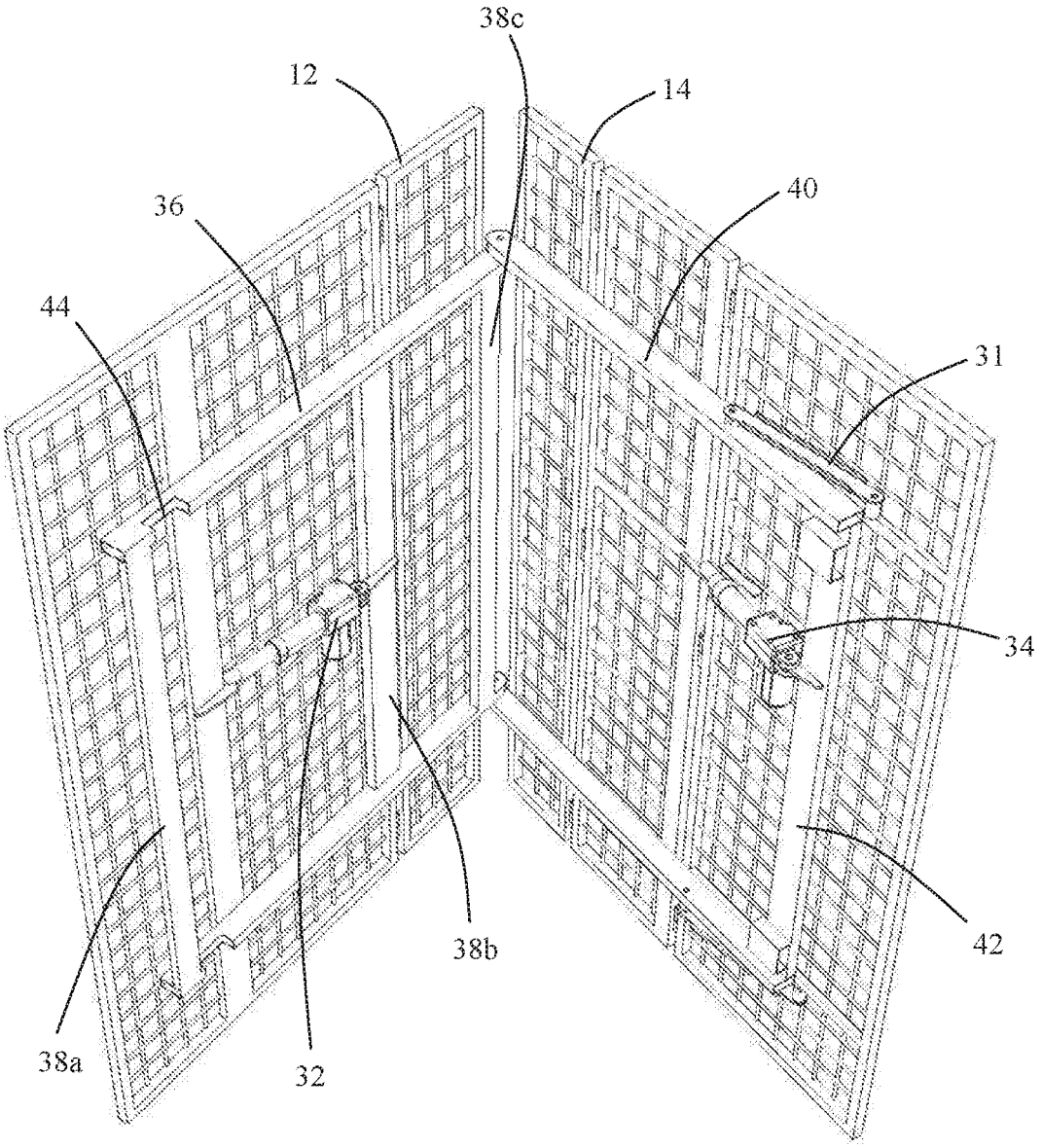
FIG. 5 shows the bed of FIG. 1 in a partially folded state.
Figure 6:
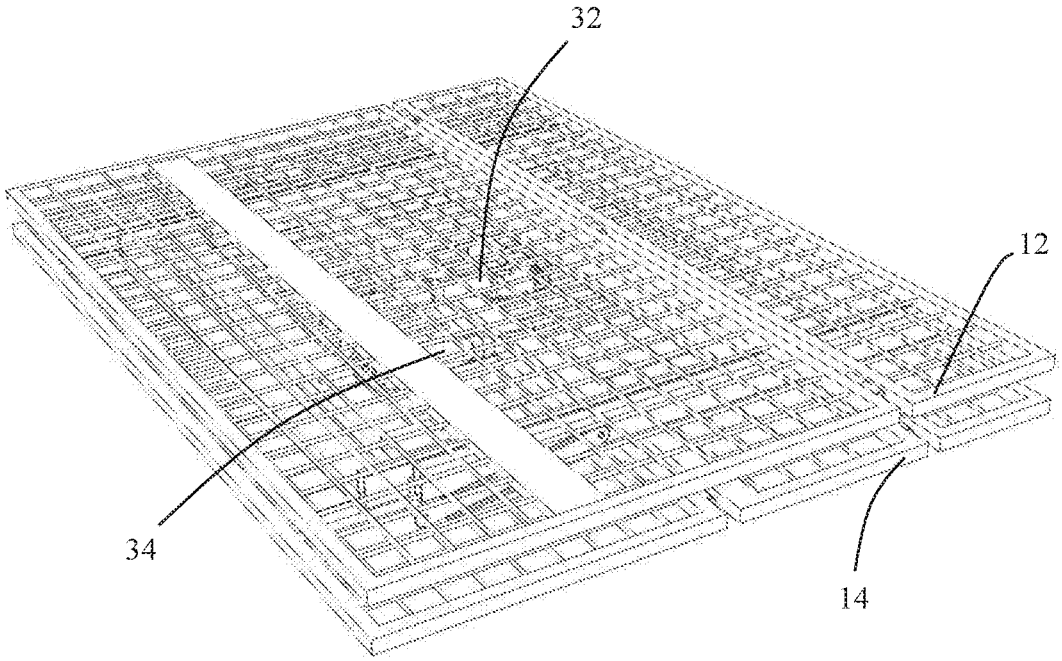
FIG. 6 shows the bed of FIG. 1 in a folded state.

Referring to FIG. 5, connected between the two first longitudinal beams 36 are three lateral beams 38*a*, 38*b*, 38*c*. The outmost first lateral beam 38*a* is connected between two ends of the first longitudinal beams 36 away from the second support bracket 18, and the innermost first lateral beam 38*c* is connected between two ends of the first longitudinal beams 36 adjacent the second support bracket 18. The first lateral beam 38*b* is positioned between the first lateral beam 38*a* and the first lateral beam 38*c*. The first actuator 32 has one end pivotably connected to the first lateral beam 38*b*, and another opposite end pivotably connected to the backrest portion 22 of the first platform section 12. Operation of the first actuator 32 can control the lifting operation of the backrest portion 22 relative to the first support bracket 16. One second lateral beam 42 is connected to two ends of the two second longitudinal beams 40 that are located away from the first support bracket 16. The second actuator 34 has one end pivotably connected to the second lateral beam 42, and another opposite end pivotably connected to the thigh support portion 28 of the second platform section 14. Operation of the second actuator 34 can lift up or lower down the thigh support portion 28 and the crus support portion 30.

The number of the linking rods 31 is two. Each linking rod 31 has one end pivotably connected to the crus support portion 30 of the second platform section 14, and another opposite end pivotably connected to an outer side of one corresponding second longitudinal beam 40.

In the illustrated embodiment, the second longitudinal beam 40 has a longitudinal length less than that of the first longitudinal beam 36, and the first lateral beam 38*a* is located outside the second lateral beam 42 in the longitudinal direction. Each first longitudinal beam 36 defines an avoidance cutout 44 at a location adjacent the first lateral beam 38*a*, corresponding to the second lateral beam 42. When the second support bracket 18 and the first support bracket 16 are folded, the second lateral beam 42 is just received in the avoidance cutout 44, and the first lateral beam 38*a* is located at an outer side of the second lateral beam 42 in the longitudinal direction, which avoid the interferences between the first longitudinal beams 36 and the second lateral beam 42, and between first lateral beam 38*a* and the second lateral beam 42.

In some other embodiments not illustrated, the longitudinal length of the second longitudinal beam 40 may be greater than that of the first longitudinal beam 36. In this case, another second lateral beam may be connected between the two ends of the two second longitudinal beams 40. The another second lateral beam may be spaced from the second lateral beam 42 by a gap in the longitudinal direction. When the second support bracket 18 and the first support bracket 16 are folded, the another second lateral beam is located at an outer side of the distal ends of the first support bracket 16 in the longitudinal direction, with the first lateral beam 38*a* located in the gap between the two second lateral beams, which can likewise avoid the interferences between the first support bracket 16 and the second support bracket 18.

Figure 7:
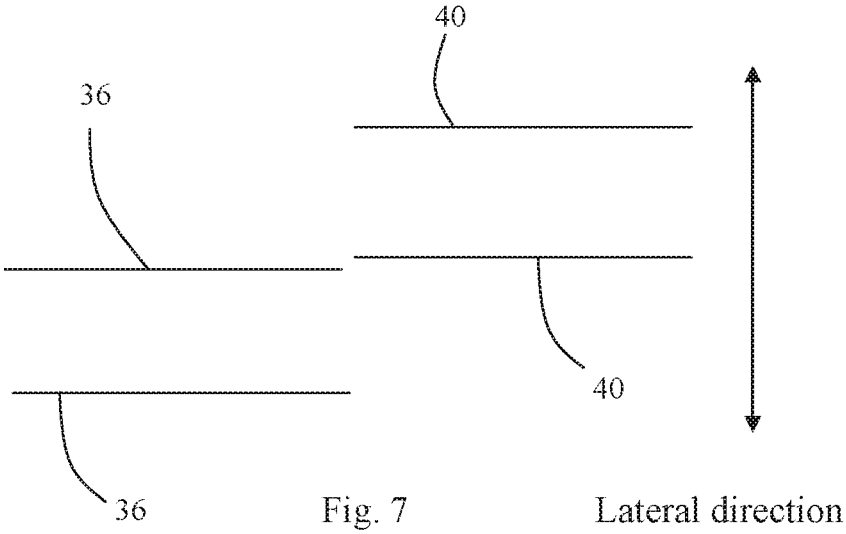
FIG. 7 shows a concept of the first support bracket entirely offset-arranged with respect to the second support bracket in the lateral direction.

Referring to FIG. 7, in some other embodiments, the two first longitudinal beams 36 are entirely offset-arranged with respect to the two second longitudinal beams 40 in the lateral direction, which can likewise avoid the interferences between the first support bracket 16 and the second support bracket 18. The term "entirely offset-arranged" used herein refers to the situation where a lateral gap between the two first longitudinal beams 36 and a lateral gap between the two second longitudinal beams 40 do not have an overlapped portion in the lateral direction. That is, both the two first longitudinal beams 36 are located on one lateral side of the bed, and both the two second longitudinal beams 40 are located on an opposite lateral side of the bed. In this case, the other structures of the first support bracket 16 and the second support bracket 18 can be suitably modified to maintain the balance of the bed. In this case, the first support bracket 16 and the second support bracket 18 can have the same or different width in the lateral direction.

Figure 8:
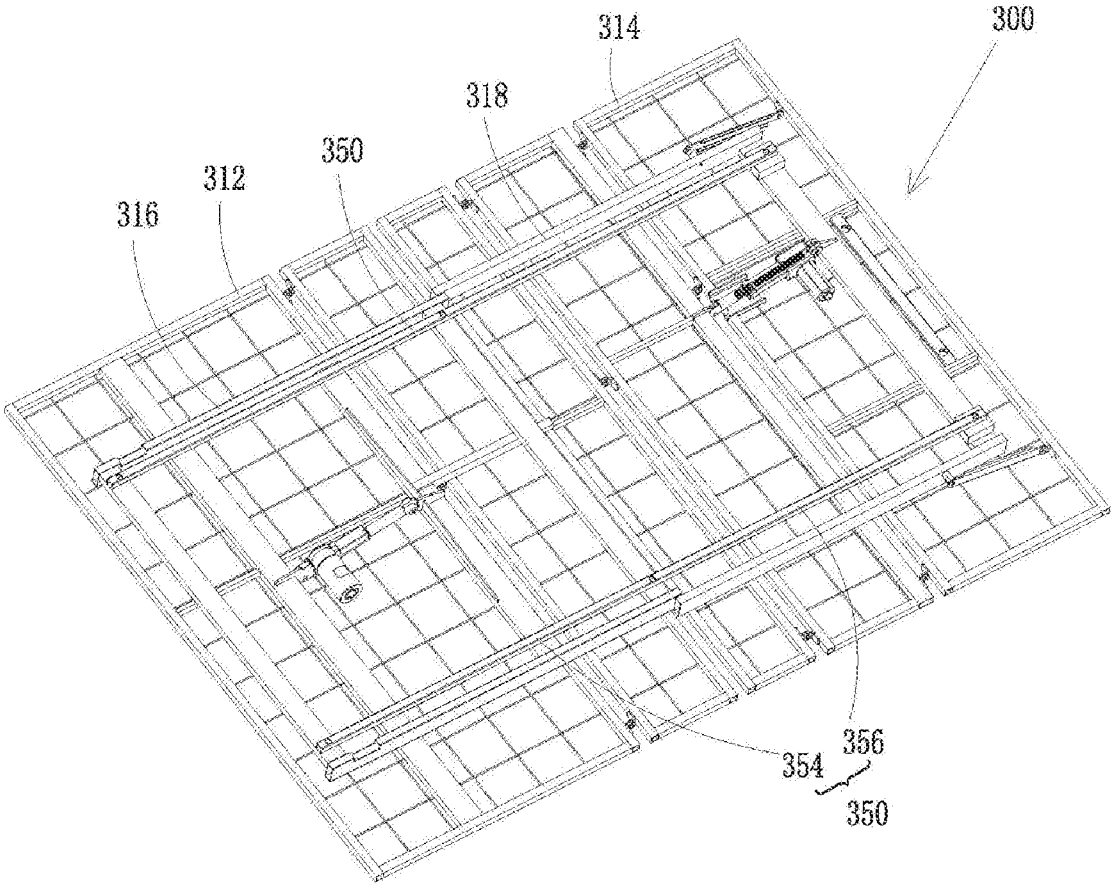
FIG. 8 is a perspective view of a bed with multiple bed units according to another embodiment.

FIG. 8 illustrates another embodiment of the bed 300 with multiple bed units. The bed 300 includes a first bed unit and a second bed unit. The first bed unit includes a first platform section 312 and a first support bracket 316 positioned at an underside of the first platform section 312. The second bed unit includes a second platform section 314 and a second support bracket 318 positioned at an underside of the second platform section 314. The bed 300 may further include a plurality of support legs. The first bed unit and the second bed unit can be constructed and connected in the same way as in the previous embodiments, except that the first bed unit and the second bed unit of the bed 300 are connected by at least one connecting bar 350. In the illustrated embodiment, the at least one connecting bar includes two connecting bars 350 located at two lateral sides of the support assembly. Each connecting bar 350 has a first bar portion 354 and an opposite second bar portion 356. The first bar portion 354 is detachably mounted to the first support bracket 316, and the second bar portion 356 is detachably mounted to the second support bracket 318, thereby connecting the first bed unit to the second bed unit to form a complete bed. In the illustrated embodiment, the connecting bar 350 is a straight bar having two bar portions for connecting to the first and second support brackets. In some other embodiments not shown, the connecting bar 350 can have any suitable shape and have any suitable number of bar portions for connecting to the first and second support brackets.

Figure 9:
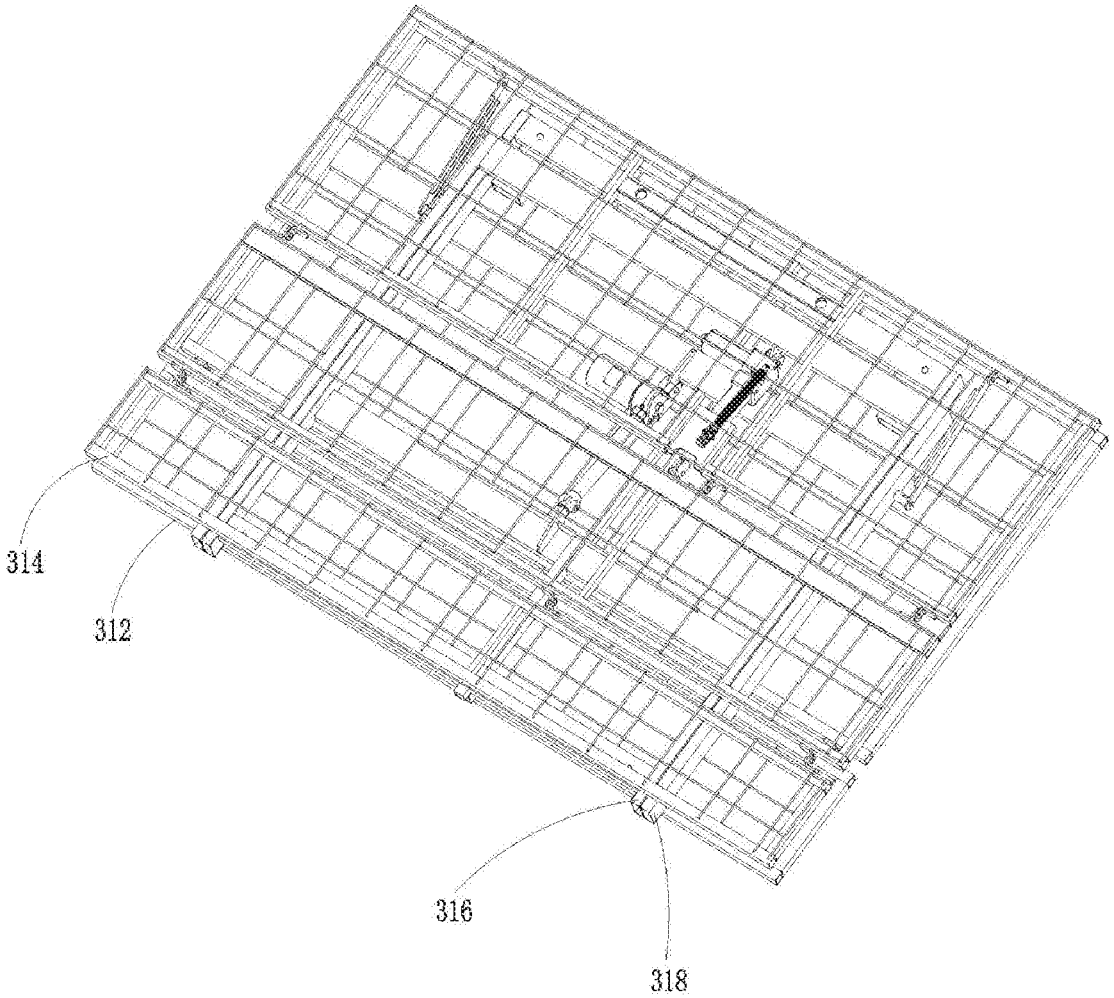
FIG. 9 shows the bed of FIG. 8 in a state where the first bed unit and the second bed unit are laid to each other.
Figure 10:
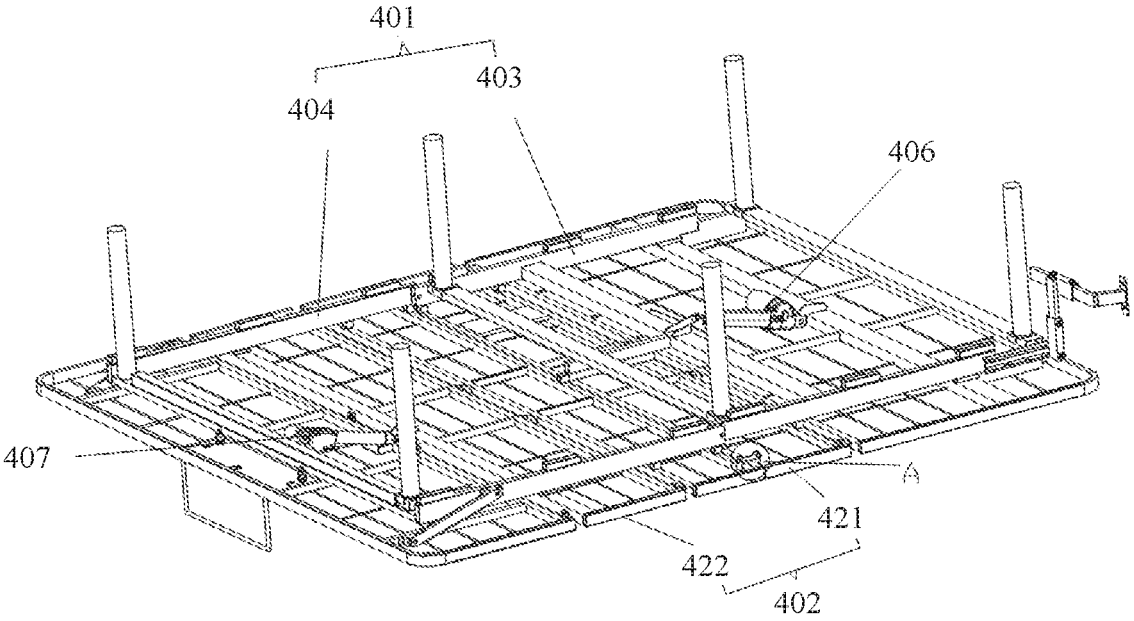
FIG. 10 illustrates a bed with multiple bed units in accordance with still another embodiment.
Figure 11:
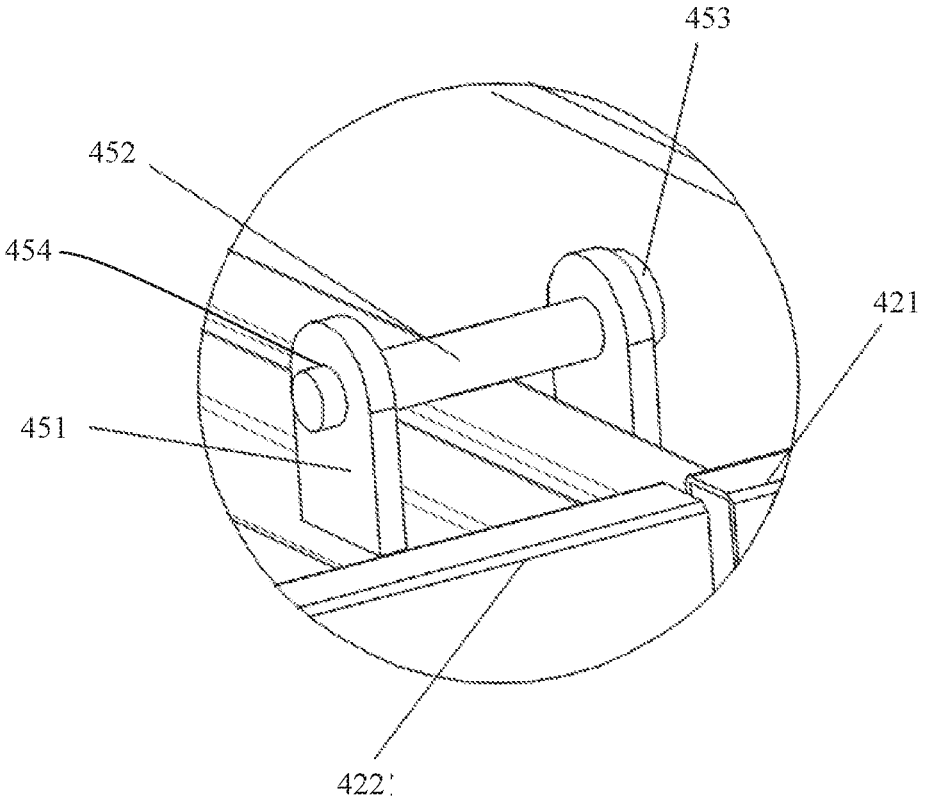
FIG. 11 is an enlarged view of part A of FIG. 10.
Figure 12:
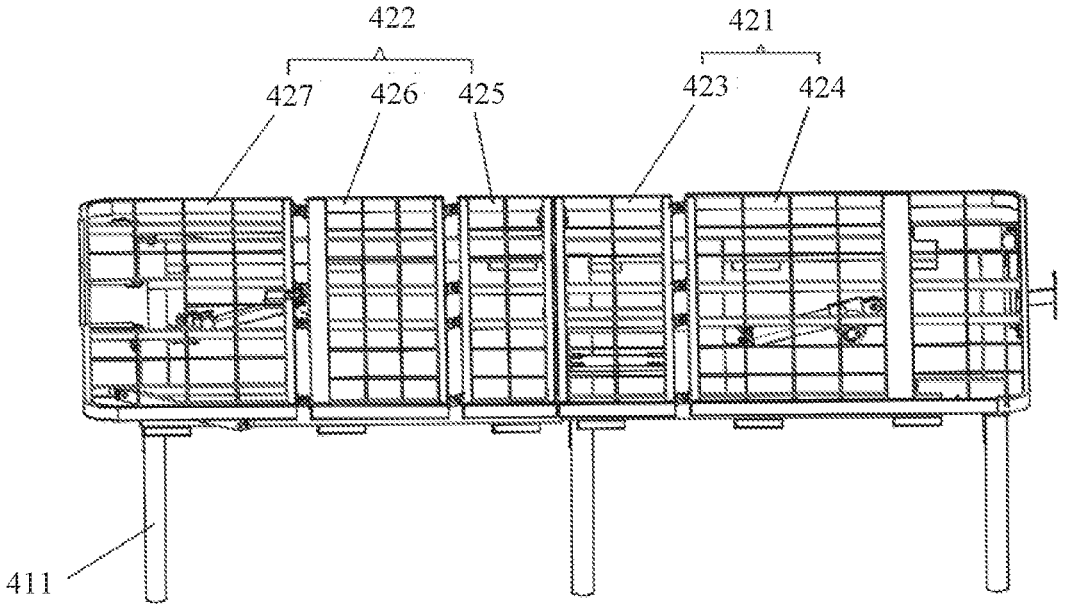
FIG. 12 is similar to FIG. 10, but viewed from another aspect.
Figure 13:
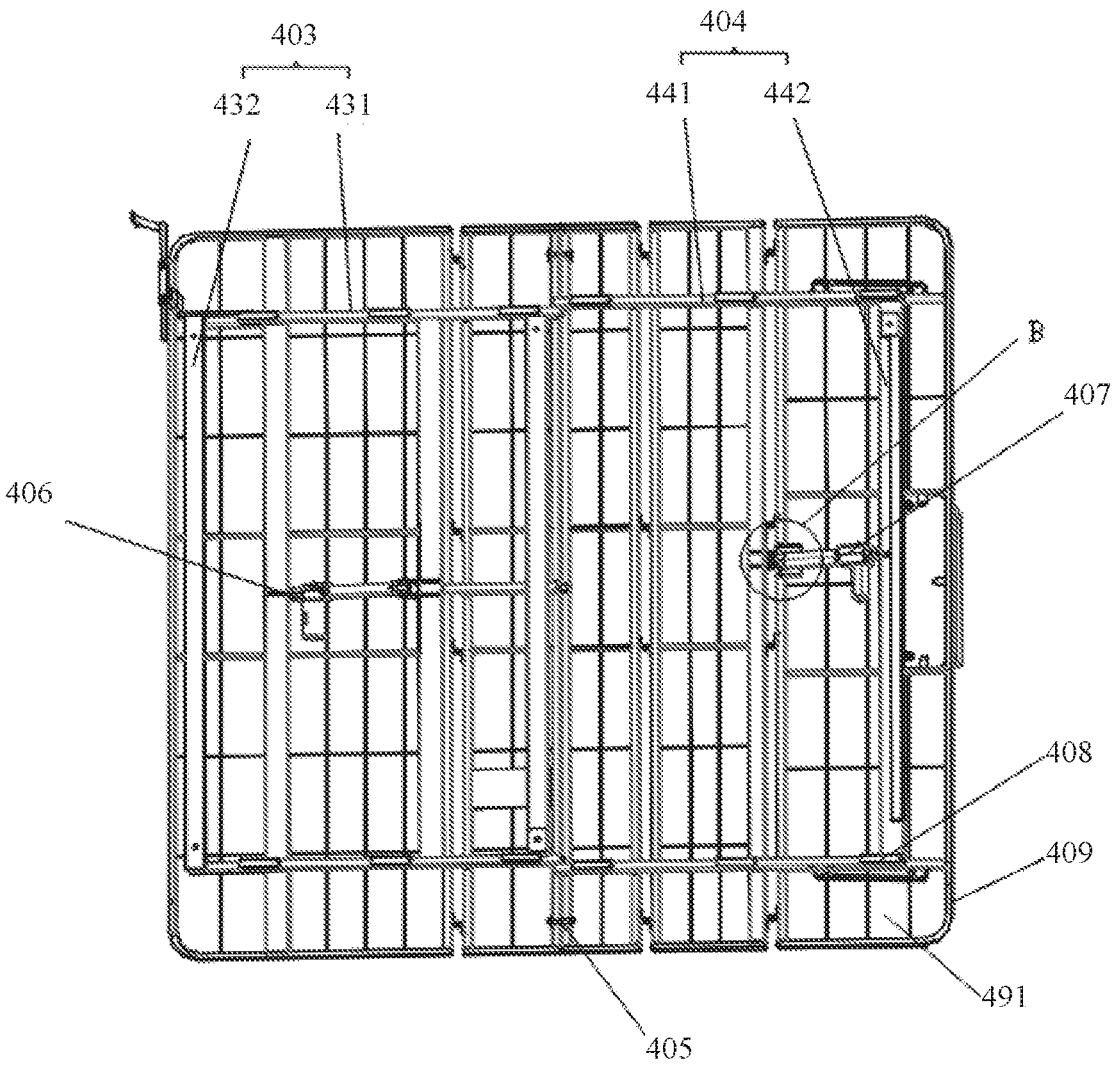
FIG. 13 illustrates the bed of FIG. 10 with legs of the bed removed.

Referring to FIG. 9, for transportation or storage purposes, the connecting bars 350 and any supporting legs are detached from the first support bracket 316 and the second support bracket 318, and the first bed unit and the second bed unit are laid to each other, with the first support bracket 316 and the second support bracket 318 laid into each other and sandwiched between the first platform section 312 and the second platform section 314. The first support bracket 316 and the second support bracket 318 of the embodiment of FIG. 8 and FIG. 9 can have the same offset-arrangement as the previous embodiments shown in FIG. 1 to FIG. 7 to minimize the overall thickness of the bed for storage or transportation, and therefore explanation of the offset-arrangement is not repeated herein In the embodiments illustrated above, the first flat plate portion 24 and the second flat plate portion 26 cooperatively form a hip support portion, which is stationary relative to the support assembly during lift operations of the backrest portion 22 and the thigh and crus support portions 28, 30. In some other embodiments not illustrated, the hip support portion can be entirely included in the first platform section 12, or entirely included in the second platform section 14. In this case, the hinging connection locations between the various portions of the platform will be modified accordingly.

FIGS. 10-15 illustrate a foldable bed 400 in accordance with still another embodiment of the present invention.

The bed 400 includes a support member 401 and a platform 402 supported on the supporting member 401. The support member 401 comprises a first support bracket 403 and a second support bracket 404. The platform 402 comprises a first platform part 421 and a second platform part 422. The first platform part 421 is supported on the first support bracket 403 to form a first bed unit. The second platform part 422 is supported on the second support bracket 404 to form a second bed unit. The first support bracket 403 and the second support bracket 404 are pivotably connected to each other such that a rotatable connection is formed between the first platform part 421 and the second platform part 422. Thus, the bed 400 is rotatable between a folded state and an unfolded state. In the unfolded state, the first platform part 421 and the second platform part 422 are coplanar and cooperatively form the platform 402 of the bed 400 configured to support a load, such as, a human body. Usually, a mattress is placed on the platform 402 during use. A stop unit 405 is arranged between the first platform part 421 and the second platform part 422, in order to stop the first support bracket 403 and the second support bracket 404 from rotating relative to each other when the bed is at the unfolded state, whereby improving stability of the bed in use.

The stop unit 405 comprises a pair of mounting bases, such as mounting plates 451, a connecting rod 452, and a restricting member 453. The mounting plates 451 are respectively disposed on the first and second platform parts 21 and 22. The mounting bases 51 each defines a through hole 454 for extension of the connecting rod 452. When the connecting rod 452 is inserted into the two through holes 53 in sequence, the restricting member 453 is connected to the end of the connecting rod 452 to thereby secure the connecting rod 452 relative to the mounting plate 51 and prevent relative rotation between the first bed board 21 and the second bed board 22 when the bed is at the unfolded state. The mounting plates 451 may be integrally formed with the first platform part 421 and the second platform part 422, or may be fixed to the first platform part 421 and the second platform part 422 by a fastener.

In the illustrated embodiment, the restricting member 453 is a nut and the end of the restricting member 453 has threads meshed with the nut.

In the illustrated embodiment, when the bed is at the unfolded state the first platform part 421 and the second platform part 422 are arranged in a longitudinal direction of the bed, and the first support bracket 403 and the second support bracket 404 are arranged in a lateral direction of the bed to avoid interference between the first support bracket 403 and the second support bracket 404 during the folding process.

In the illustrated embodiment, a first actuator 406 is connected to the first platform part 421 and the first support bracket 403, for driving the first platform part 421 to move, for example, rotate relative to the first support bracket 403. The second platform part 422 and the second support bracket 404 are connected with a second actuator 407 for driving the second platform part 422 to move, for example, rotate relative to the second support bracket 404. The first actuator 406 and the second actuator 407 are offset from each other in the lateral direction of the bed to avoid interference between the two actuators 406, 407 during the folding process.

In the illustrated embodiment, the first support bracket 403 includes two first rotation arms 431 and a first support rod 432 provided between the two first rotation arms 431. The second support bracket 404 includes two second rotation arms 41 and a second support rod 42 provided between the two second rotation arms 41. An end of the first rotation arm 31 is hinged to an end of the second rotation arm 41.

Figure 3:
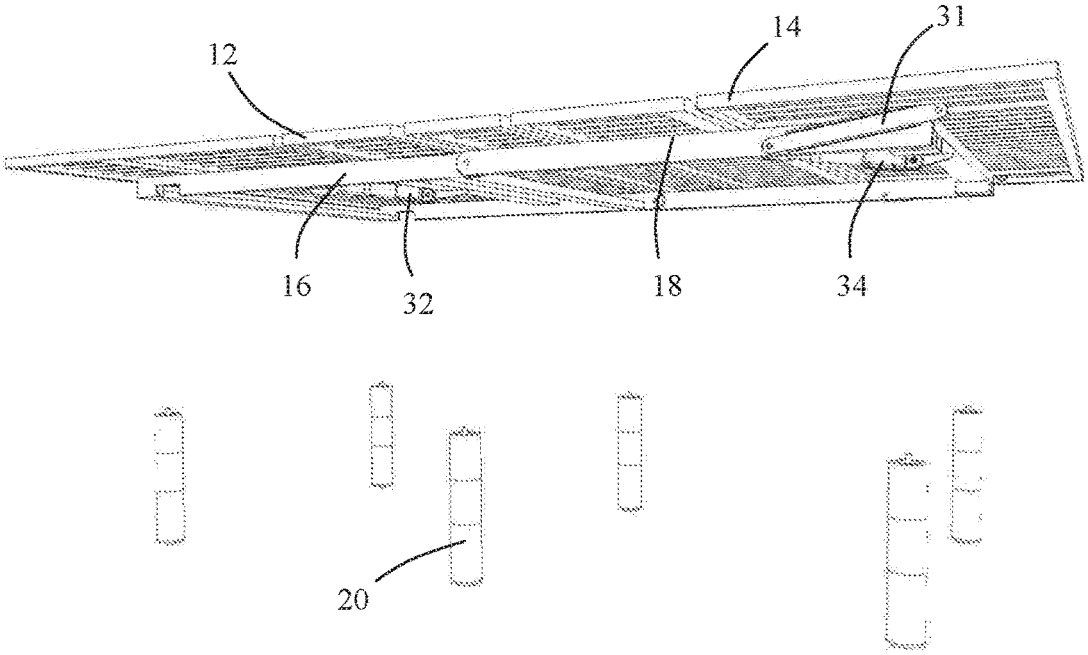
FIG. 3 is a partially exploded view of the bed of FIG. 1.

Referring to FIG. 3, the first platform part 421 comprises a first platform section 423 and a second platform section 424 pivotably connected to the first platform section 423. The first platform section 423 is adjacent to the second platform part 422 and the second platform section 424 is away from the second platform part 422. One end of the actuator 406 is pivotably connected to the first support rod 432 and the other end of the actuator 406 is pivotably connected to the second platform section 424.

The second platform part 422 comprises a third platform section 425, a fourth platform section 426 and a fifth platform section 427. The third platform section 425 is adjacent to the first platform part 23, the fourth platform section 426 is pivotably connected to the third platform section 425, and the fifth platform section 427 is pivotably connected to the fourth platform section 426. One end, i.e., motor end of the second actuator 407 is pivotably connected to the second support rod 42 and the other end, i.e., pushing end of the second actuator 407 is pivotably connected to the fourth platform section 426.

Each of the first, second, third, fourth and fifth platform sections 423, 424, 425, 426 and 427 includes a support frame 409 and a hollow portion 491.

In the illustrated embodiment, the distance between the two first rotation arms 431 is smaller than the distance between the two second rotation arms 441, so as to prevent interference between the first rotation arm 431 and the second rotation arm 441 during the folding process.

Figure 14:
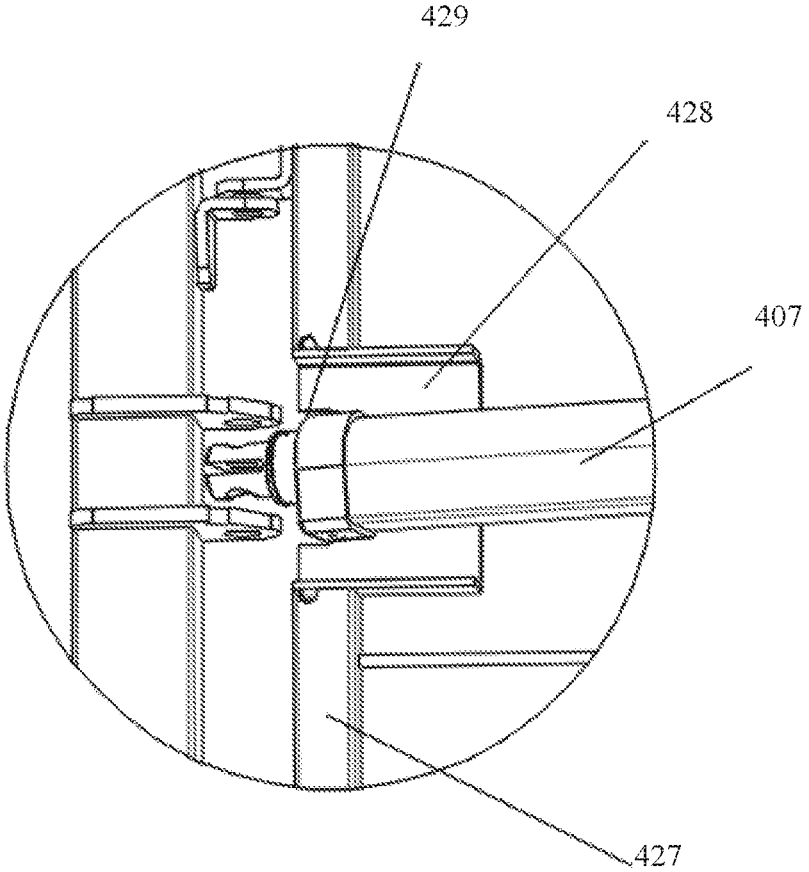
FIG. 14 is an enlarged view of part B of FIG. 13.
Figure 15:
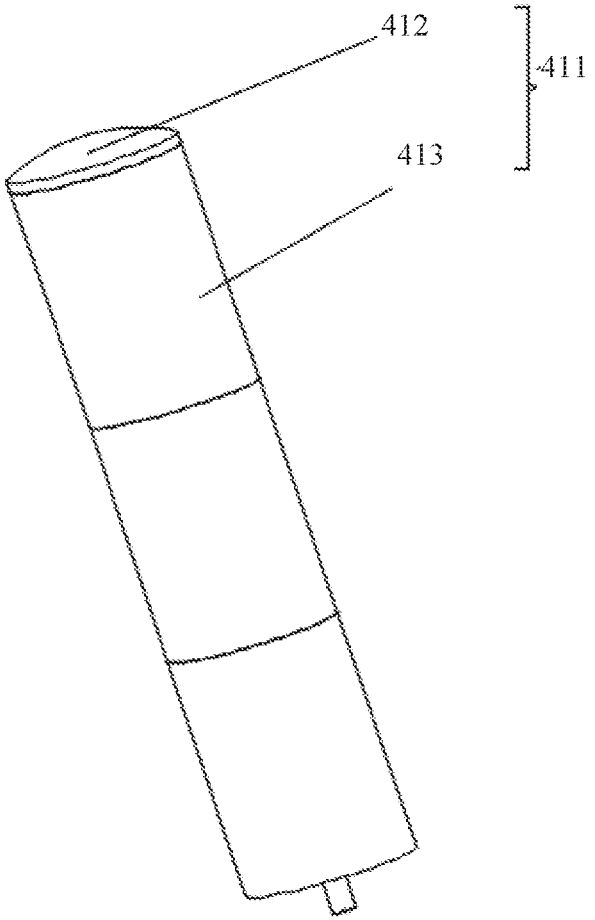
FIG. 15 is a perspective view of a leg of the bed of FIG. 10.

In the illustrated embodiment, the bed further comprises a plurality of legs 411. Some of the legs 411 are detachably mounted on the first support bracket 403, and the other of the legs 411 are detachably mounted on the second support bracket 404. Specifically, as shown in FIG. 14, the leg 411 includes an end portion 412 and a plurality of support portions 413. The plurality of support portions 413 and the end portion 412 are detachably connected to one another to form the leg 411. According to different requirements on the height of the bed, one or more of the supporting portions 413 can be disassembled from the leg 411 to reach the required height, so as to adjust the height of the bed and improve the applicability of the bed.

The leg 411 is configured as a support structure to support the platform at a predetermined distance from the ground. It can be understood that, in other embodiments, the support structure may also be implemented as another type of support structure, such as a support frame having a height adjustment function (for example, scissor type of support structure). In the illustrated embodiment, two more legs 411 are mounted in the middle of the platform.

Figure 4:
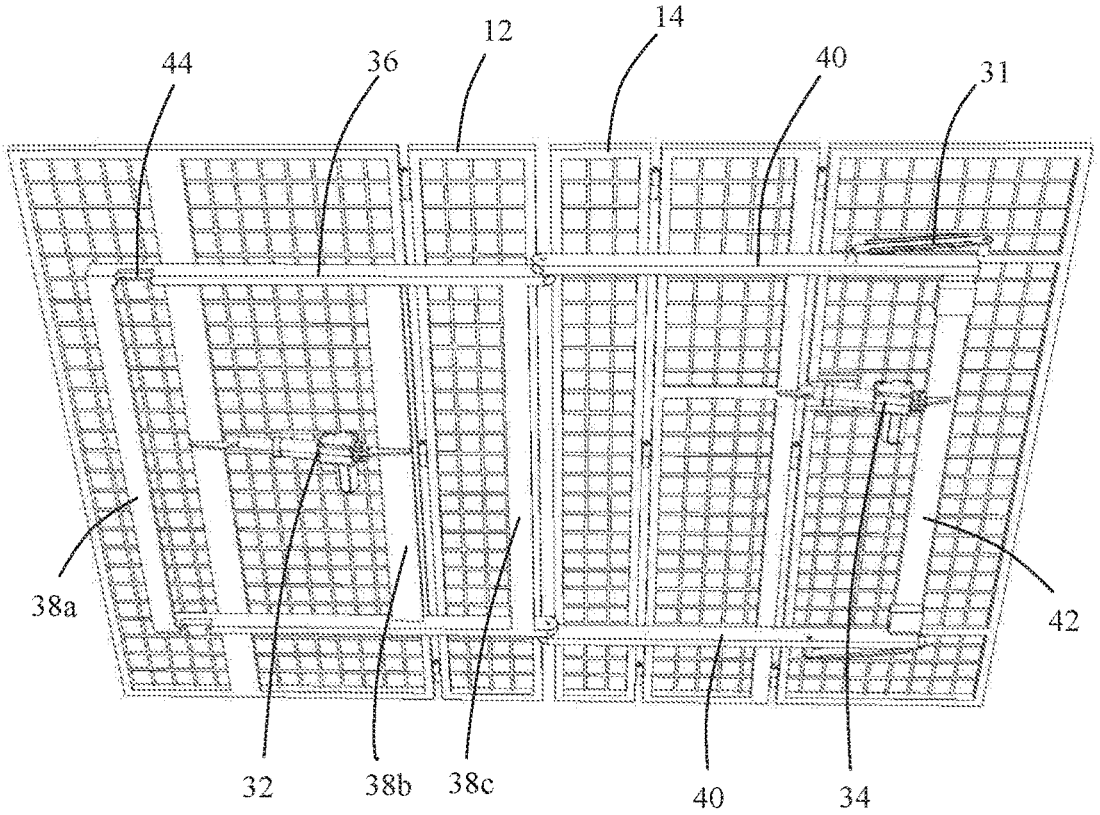
FIG. 4 shows the bed of FIG. 1 in an unfolded state.

In the illustrated embodiment, a support seat 408 (as shown in FIG. 4) is provided on the lower surfaces of the first and second rotation arms 431 and 441. When in use, the distance between the lower surface of the support seat 8 and the ground is less than the distance between the lowermost end of the first actuator 406 and the ground, and the distance between the lower surface of the support seat 8 and the ground is less than the distance between the lowermost end of the second actuator 407 and the ground. The support seat 408 is offset from the support frame 409. When the bed is at the folded state, the support seat 408 is located in the hollow portion 491, so as to avoid interference between the support seat 408 and the support frame 409 at the folded state.

After the leg 411 is removed from the platform, the support seat 408 can be used as a support structure to support the platform with a required support height.

Figure 16:
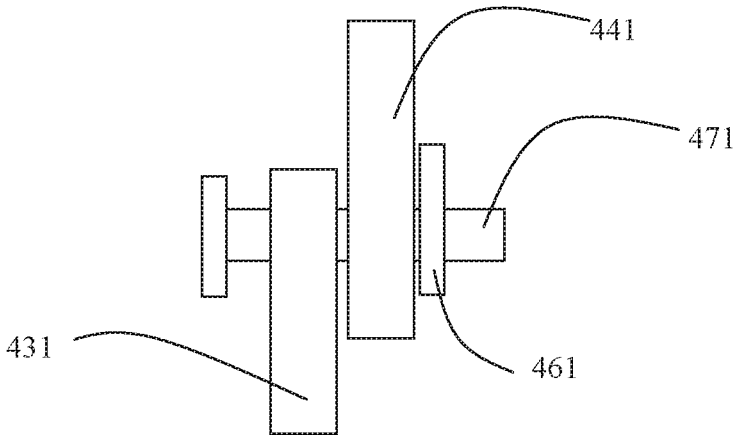
FIG. 16 is a schematic diagram showing a clamping member provided at the end of a hinge shaft through which the first rotation arm pivotably connected to the second rotation arm.

Referring to FIG. 16, in the illustrated embodiment, a clamping member 461 is provided at the end of a hinge shaft 471 through which the first rotation arm 431 is pivotably connected to the second rotation arm 441, for securing the hinge shaft 471 between the first rotation arm 431 and the second rotation arm 441 and improving stability.

In the illustrated embodiment, the fifth platform section 427 is provided with a recess 428 at the support frame 409 below the pushing end of the second actuator 407. A groove 429 is formed at the bottom of the recess 428 to allow rotation of the pushing end of the second actuator 407 therein. Thus, a space is left for rotation of the pushing rod of the second actuator 407, thereby preventing the pushing rod of the second actuator 407 from damaging the support frame 9 on the fifth platform section 427 during operation.

After the legs 411 are detached from the first and second support brackets 3, 4, the first platform part 421 and the second platform part 422 are capable of rotation relative to each other between the folded state and the unfolded state. In the unfolded state, the first platform part 421 and the second platform part 422 cooperatively form the platform for supporting the load. The stop unit 405 arranged at the rotatable connection between the first platform part 421 and the second platform part 422 is capable of stopping the first platform part 421 and the second platform part 422 from rotating relative to each other, whereby improving stability of the bed in use. In the folded state, the first and second platform parts 421, 422 are folded to each other, with the first support bracket 403 and second support bracket 404 folded and sandwiched between the first platform part 421 and the second platform part 422. In this case, the overall thickness of the folded bed is defined by the distance between outer surfaces of the folded first and second platform parts 421, 422. In order to minimize this overall thickness, in this embodiment, the first support bracket 403 and the second support bracket 404 are offset-arranged in the lateral direction of the bed such that the first support bracket 403 and the second support bracket 404 do not interference with each other when the first and second platform parts 421, 422 are folded, making it possible to completely fold the first support bracket 403 and second support bracket 404 into each other. As a result, the distance between inner surfaces (which are bottom surfaces of the first and second platform parts 421, 422 when unfolded) of the folded first and second platform parts 421, 422 is approximately equal to a thickness of the first support bracket 403 or the second support bracket 404. The overall thickness of the folded bed is therefore approximately equal to a sum of a thickness of the first platform part 421, a thickness of second platform part 422, and a thickness of the first support bracket 403 or second support bracket 404. The first platform part 421 and the second platform part 422 when folded are substantially parallel to each other. As used herein, the term "thickness" refers to the size perpendicular to the platform.

In the illustrated embodiment, the first platform part 421 and the second platform part 422 are not directly connected to each other. Rather, the first support bracket 403 and the second support bracket 404 are hinged to each other, i.e. rotatable connection is only formed between the first support bracket 403 and the second support bracket 404. The first platform part 421 is fixed to the first support bracket 403, and the second platform part 422 is fixed to the second support bracket 404. Therefore, as the second support bracket 404 rotates relative to the first support bracket 403, it will bring the second platform part 422 to rotate relative to the first platform 4021.

In some other embodiments, the first platform part 421 can be hinged to the second platform part 422. In this case, no direction connection is needed between the first support bracket 403 and the second support bracket 404. It should be understood that, for purposes of folding operation, rotatable connection can be formed between the first platform part 421/second platform part 422 and/or the first support bracket 403/second support bracket 404.

In summary, the present invention provides a foldable bed with multiple bed units that can be connected to cooperatively form a complete bed. The multiple bed units can be rotatably connected to each other, or connected using another connecting system, such as using at least one connecting bar. By offset-arranging the first support bracket and the second support bracket in the lateral direction, the first support bracket and the second support bracket do not interference with each other when the first and second bed units are folded or laid into each other. Therefore, the bed thickness after the first and second bed units are folded or laid into each other can be greatly reduced, thus reducing the packaging size of the bed and hence reducing the cost in transportation of the bed. The stop unit is arranged at the rotatable connection between the first bed unit and the second bed unit, in order to stop the first bed unit and the second bed unit from rotating relative to each other when the bed is at the unfolded state, whereby improving stability of the bed in use.

Although the invention is described with reference to one or more embodiments, it will be apparent to those skilled in the art that various modifications and variations can be made to the disclosed structure without departing from the scope or spirit of the invention. In view of the foregoing, it is intended that the present invention cover modifications and variations of this invention provided they fall within the scope of the following claims and their equivalents.

What is claimed is:

1. A foldable bed, comprising:

a first bed unit comprising a first platform part (12), a first support bracket (16) mounted at an underside of the first platform part and a first actuator (32) connected between the first platform section (12) and the first support bracket (16) for driving the first platform section (12) to move relative to the first support bracket (16), the first platform part (12) comprising a first flat plate portion (24) and a backrest portion (22) rotatably hinged to the first flat plate portion (24); and a second bed unit connected to the first bed unit, the second bed unit comprising a second platform part (14), a second support bracket (18) mounted at an underside of the second platform part and a second actuator (34) connected between the second platform section (14) and the second support bracket (18), the second platform part (14) comprising a second flat plate portion (26), a thigh support portion (28) rotatably connected to the second flat plate portion (26), and a crus support portion (30) rotatably connected to the thigh support portion (28), wherein the second platform part and the first platform part cooperatively form a platform of the bed for supporting a load, the platform defining a longitudinal direction, a thickness direction and a lateral direction perpendicular to the longitudinal direction and the thickness direction, the first platform part and the second platform part being distributed in the longitudinal direction;

wherein the first support bracket (16) includes two first longitudinal beams (36) extending in the longitudinal direction, the second support bracket (18) includes two second longitudinal beams (40) extending in the longitudinal direction, the first longitudinal beams (36) of the first support bracket and the second longitudinal beams (40) of the second support bracket are offset-arranged in the lateral direction to avoid interferences between the first support bracket and the second support bracket when the first bed unit and the second bed unit are laid to each other at a folded state;

wherein the two first longitudinal beams (36) are spaced from each other along the lateral direction, the two second longitudinal beams (40) are spaced from each other along the lateral direction, each of the first longitudinal beams (36) has a first end rotatably connected to a second end of one corresponding second longitudinal beam (40) with the first end being misaligned with the second end in the lateral direction such that at the folded state the first and second longitudinal beams are overlapped in the thickness direction and a distance between inner surfaces of the folded first and second platform parts is substantially equal to a thickness of the first support bracket or the second support bracket;

wherein a first lateral beam (38*a*) is connected between the two spaced first longitudinal beams (36), a second lateral beam (42) is connected between the two spaced second longitudinal beams (40), the second actuator (34) has one end pivotably connected to the second lateral beam (42) and another opposite end pivotably connected to the thigh support portion (28) of the second platform section (14), the second longitudinal beams (40) are located outside the first longitudinal beams (36) in the lateral direction, the first longitudinal beam (36) located under the backrest portion (22) and the first flat plate portion (24) has a longitudinal length greater than that of the second longitudinal beam (40) located under the second flat plate portion (26), the thigh support portion (28) and the crus support portion (30) such that the first lateral beam (38*a*) is located outside the second lateral beam (42) and the second actuator (34) in the longitudinal direction after the first support bracket and the second support bracket are laid into each other; and wherein each of the first longitudinal beams (36) defines an avoidance cutout (44) at a position corresponding to a portion of the second lateral beam (42) such that when the first support bracket and the second support bracket are laid into each other at the folded state, the portions of the second lateral beam (42) are received in the avoidance cutouts (44) respectively to avoid interference between the first longitudinal beams and the second lateral beam, the avoidance cutout (44) being located between the first lateral beam (38*a*) and the first end of the first longitudinal beam (36);

wherein said first lateral beam (38*a*) is an outmost first lateral beam connected between two ends of the first longitudinal beams (36) away from the second support bracket (18), an innermost first lateral beam (38*c*) is connected between other two ends of the first longitudinal beams (36) adjacent the second support bracket (18), a middle first lateral beam (38*b*) is positioned between the first lateral beam (38*a*) and the first lateral beam (38*c*) and connected between the first longitudinal beams (36), the first actuator (32) has one end pivotably connected to the middle first lateral beam (38*b*), and another opposite end pivotably connected to the backrest portion (22) of the first platform section (12), and the first actuator and the second actuator are offset-arranged in the lateral direction.

2. The foldable bed of claim 1, wherein the first bed unit and the second bed unit are connected by at least one connecting bar extending in the longitudinal direction, and the at least one connecting bar includes a first bar portion detachably connected to the first support bracket and a second bar portion detachably connected to the second support bracket.

3. The foldable bed of claim 1, wherein a stop unit is arranged between the first platform part and the second platform part for preventing the first platform part and the second platform part from rotating relative to each other when the bed is at the unfolded state.

4. The foldable bed of claim 3, wherein the stop unit comprises a pair of mounting bases respectively mounted to the first and second platform parts, a connecting rod connected between the mounting bases and a restricting member connected to the connecting rod and configured to prevent the connecting rod from moving off from the mounting bases, the mounting bases being plate-shaped and arranged perpendicular to the longitudinal direction, the pair of mounting bases being spaced from each other in the longitudinal direction.

5. The foldable bed of claim 4, wherein each of the mounting bases comprises an end mounted to the platform and an opposite end away from the platform, the opposite end defines a through hole, the connecting rod extending through the through holes, the restricting member being mounted to an end of the connecting rod.

6. A foldable bed, comprising:

a support member comprising a first support bracket comprising two first longitudinal beams extending along a longitudinal direction of the foldable bed and a second support bracket comprising two second longitudinal beams extending along the longitudinal direction of the foldable bed; and a platform for supporting a load, the platform comprising a first platform part supported on the first support bracket and a second platform part supported on the second support bracket;

wherein the first support bracket is rotatably connected to the second support bracket such that the first platform part and the second platform part are rotatable relative to each other between a folded state and an unfolded state;

wherein the two first longitudinal beams are spaced from each other along the lateral direction, the two second longitudinal beams are spaced from each other along the lateral direction, each of the first longitudinal beams has a first end rotatably connected to a second end of one corresponding second longitudinal beam with the first end being offset from the second end in the lateral direction such that at the folded state the first and second longitudinal beams are overlapped in the thickness direction;

wherein a first lateral beam is connected between the two spaced first longitudinal beams, a second lateral beam is connected between the two spaced second longitudinal beams, the second longitudinal beams are located outside the first longitudinal beams in the lateral direction, the second longitudinal beam has a longitudinal length less than that of the first longitudinal beam such that the first lateral beams is located outside the second lateral beam in the longitudinal direction after the first support bracket and the second support bracket are laid into each other; and wherein each of the first longitudinal beams defines an avoidance cutout at a position corresponding to a portion of the second lateral beam such that when the first support bracket and the second support bracket are laid into each other at the folded state, the portions of the second lateral beam are received in the avoidance cutouts respectively to avoid interference between the first longitudinal beams and the second lateral beam, the avoidance cutout being located between the first lateral beam and the first end;

wherein said first lateral beam (38*a*) is an outmost first lateral beam connected between two ends of the first longitudinal beams away from the second support bracket, an innermost first lateral beam (38*c*) is connected between other two ends of the first longitudinal beams adjacent the second support bracket, a middle first lateral beam (38*b*) is positioned between the first lateral beam (38*a* and the first lateral beam (38*c*) and connected between the first longitudinal beams, the first actuator has one end pivotably connected to the middle first lateral beam (38*b*), and another opposite end pivotably connected to the backrest portion of the first platform section, and the first actuator and the second actuator are offset-arranged in the lateral direction.

7. The foldable bed of claim 6, wherein a first actuator is connected between the first platform part and the first support bracket, for driving the first platform part to move relative to the first support bracket, a second actuator is connected between the second platform part and the second support bracket, for driving the second platform part to move relative to the second support bracket, and the first actuator and the second actuator are offset-arranged in the lateral direction.

8. The foldable bed of claim 7, wherein the first platform part includes a first flat plate portion adjacent the second platform part and a backrest portion rotatably connected with the first flat plate portion and away from the second platform part; and wherein the second platform part includes a second flat plate portion adjacent the first flat plate portion, a thigh support portion rotatably connected to the second flat plate portion, and a leg support portion rotatably connected to the thigh support portion, and the second actuator has one end rotatably connected to the second lateral beam and another opposite end rotatably connected to the thigh support portion.

9. The foldable bed of claim 6, wherein a stop unit is arranged between the first platform part and the second platform part for preventing the first platform part and the second platform part from rotating relative to each other when the bed is at the unfolded state.

10. The foldable bed of claim 9, wherein the stop unit comprises a pair of mounting bases respectively mounted to the first and second platform parts, a connecting rod connected between the mounting bases and a restricting member connected to the connecting rod and configured to prevent the connecting rod from moving off from the mounting bases, the mounting bases being plate-shaped and arranged perpendicular to the longitudinal direction, the pair of mounting bases being spaced from each other in the longitudinal direction.

11. The foldable bed of claim 10, wherein each of the mounting bases comprises an end mounted to the platform and an opposite end away from the platform, the opposite end defines a through hole, the connecting rod extending through the through holes, the restricting member being mounted to an end of the connecting rod.

12. The foldable bed of claim 6, wherein when the first support bracket and the second support bracket are laid into each other at the folded state, a distance between inner surfaces of the folded first and second platform parts is substantially equal to a thickness of the first support bracket or the second support bracket.

* * * * *